US006885332B2

(12) United States Patent
Panek et al.

(10) Patent No.: US 6,885,332 B2
(45) Date of Patent: Apr. 26, 2005

(54) MULTI-PIECE GUN BARREL SHROUD SYSTEM

(75) Inventors: Alan W. Panek, Andover, MN (US); John P. Hinsverk, Minneapolis, MN (US)

(73) Assignee: United Defense, L.P., Arlington, VA (US)

( * ) Notice: Subject to any disclaimer, the term of this patent is extended or adjusted under 35 U.S.C. 154(b) by 7 days.

(21) Appl. No.: 10/327,391

(22) Filed: Dec. 20, 2002

(65) Prior Publication Data

US 2004/0119629 A1 Jun. 24, 2004

(51) Int. Cl.[7] ..... H01Q 17/00

(52) U.S. Cl. ..... 342/1; 342/3; 342/4; 342/53; 89/14.1

(58) Field of Search ..... 342/1, 2, 3, 4, 342/13, 57, 53; 89/14.1

(56) References Cited

U.S. PATENT DOCUMENTS

| | | | | |
|---|---|---|---|---|
| 4,638,713 A | | 1/1987 | Milne | 89/14.1 |
| 4,762,048 A | | 8/1988 | Higashi | 89/14.1 |
| 4,841,836 A | | 6/1989 | Bundy | 89/14.1 |
| 4,982,648 A | | 1/1991 | Bol | 89/14.1 |
| 5,062,346 A | | 11/1991 | Greve Hansen | 89/14.1 |
| 5,400,691 A | | 3/1995 | Suttie | 89/14.1 |
| 5,438,333 A | * | 8/1995 | Perkins et al. | 342/4 |
| 5,726,375 A | | 3/1998 | Adams | 89/14.1 |
| 6,314,857 B1 | | 11/2001 | Schmidt | 89/14.1 |

* cited by examiner

*Primary Examiner*—John B. Sotomayor
(74) *Attorney, Agent, or Firm*—Patterson, Thuente, Skaar & Christensen, P.A.

(57) ABSTRACT

The present invention is a multi-piece barrel shroud which provides IR signature and radar backscatter reduction over the entire length of the barrel by utilization of special radar absorbing materials and shaped in accordance with commonly known radar signature reduction techniques. The interior of the shroud includes cooling passages for the circulation of ambient air by way of a forced air circulation system which provides IR reduction. To facilitate barrel movement while minimizing weight, the majority of the shroud is stationary and is independent of the gun barrel. At least one other piece of the shroud is attached to the barrel near the muzzle end and designed to move in unison with the muzzle during recoil. The recoiling portion of the shroud is sized to mate with an annular recess within the distal end of the stationary portion so as to provide continuous shielding of the barrel throughout the entire range of recoil displacement.

35 Claims, 6 Drawing Sheets

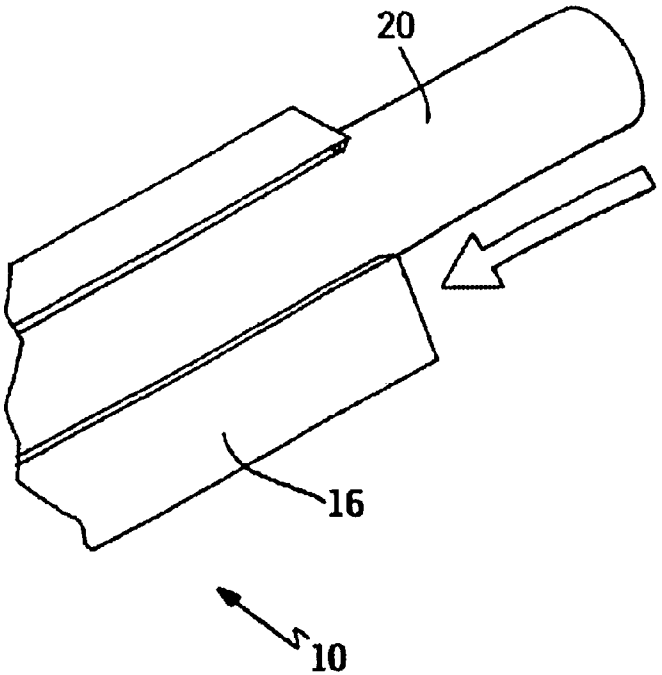
FIG. 3
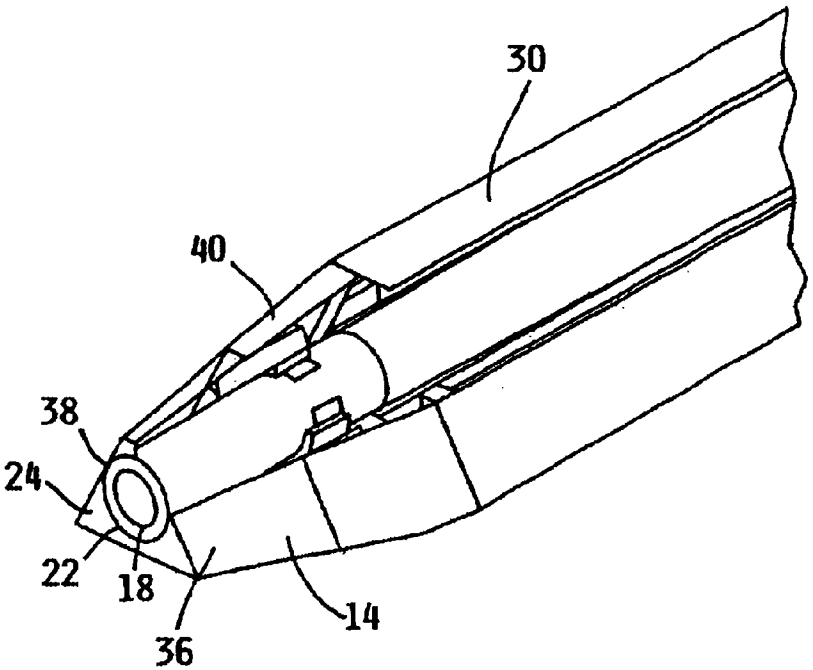

MULTI-PIECE GUN BARREL SHROUD SYSTEM

FIELD OF THE INVENTION

This invention relates to a protective covering for a large caliber gun barrel. More particularly, the invention relates to a multi-piece barrel shroud to reduce the radar backscatter and infrared signature of the barrel of a large caliber gun subject to high rates of fire.

BACKGROUND OF THE INVENTION

As the capabilities of weapon systems increase there is a corresponding need to make military assets more difficult to detect. Naval ships, like aircraft, can benefit from stealth technologies which reduce infrared (IR) and radar signatures. IR signature reduction is typically addressed by cooling and masking techniques. Radar signature reduction is achieved by a combination of a shaping and coatings or absorbers. However, while aircraft weapon systems can be masked by placing them inside the fuselage, naval designers are challenged in that certain weapons systems, such as the main gun, are simply too massive to hide within the superstructure.

Conventional gun barrels have characteristics that make them relatively easy to detect by infrared (IR) sensors and by radar. Their long, cylindrical shape tends to create strong return signals when illuminated by radar from almost any axis. Further exacerbating the return signature is the multiple bounce effect of the barrel interacting with neighboring surfaces of the superstructure.

A number of factors can create a large IR contrast between a gun barrel and its background. The most formidable IR signature effect is due to the heating of the barrel from the propelling charge. Each time the gun is fired, the barrel is heated by friction due to contact between the shell and the rifled barrel as well as the explosive propellant charge. After repeated firing, the temperature of a barrel can reach levels of 500° to 800° Fahrenheit above that of the surrounding background. This large temperature rise is not limited to the rear portion of the barrel but continues to, and includes, the muzzle. Moreover, the large mass and thick walls of the gun barrel result in heat retention long after firing ceases. This severely limits the effectiveness of simply supplying an insulating media to the barrel.

Barrel signature reduction methods must be compatible with the challenging operating conditions experienced by the gun. Firing a projectile subjects a gun barrel and the shroud to high recoil accelerations in excess of 100 Gs. Furthermore, the axial displacement of the gun barrel during the recoil cycle must be accounted for when attaching a shroud. The gun barrel recoil mechanism allows the barrel to recoil into the gun mount. A fixed rigid shroud encompassing the length of the barrel must be designed to accommodate barrel travel during recoil.

Firing the gun produces an additional design constraint at the muzzle end of the barrel. A shroud must account for a shock wave known as "muzzle blast" upon exit of the projectile. The shock wave is detrimental to any structure forward or transverse of the barrel muzzle. The muzzle blast effect is further complicated by the fact that the gun barrel begins to recoil prior to the exit of the projectile and continues to move rearward during the generation of a muzzle blast. If this movement is not correctly accounted for in the design of the shroud, the potential exists to expose elements of the shroud to the large pressures of the muzzle blast.

Most gun mounts must also be capable of moving the barrel in multiple axes to allow aiming of the gun at a wide range of target positions. The weight and inertia of the gun barrel and its associated hardware predominantly determines the size of the power drives required to aim a gun mount. It is paramount that weight and inertia of the shroud be minimized so as not to adversely effect operation of the gun.

U.S. Pat. Nos. 4,638,713, 4,753,154, 4,982,648, 5,062,346, and 6,314,857 describe various means of thermal reduction systems for gun barrels. For example, U.S. Pat. No. 4,753,154 describes a system in which the gun barrel is surrounded by a cylinder containing a working fluid. Other cooling systems involve air and insulation materials. Such solutions focus more on barrel cooling for maintaining rates of fire as compared to reducing thermal signatures. Furthermore, these designs do not address a reduction in the radar signature.

U.S. Pat. No. 5,400,691 describes a sleeve for a tank barrel which provides radar and IR signature reduction. An air gap is created between the barrel and inner sleeve of the device. The single piece rigid sleeve is of a honeycomb or foam construction. The air gap is sealed at opposing ends of the sleeve by a silicon ring which is intended to absorb the recoil energy. The solution does not address or alleviate the heating created by advanced guns capable of high rates of sustained fire. Furthermore, the rubber rings cannot absorb the recoil energy associated with large caliber weapons where firing results in recoil travel of more than one foot.

In summary, to enhance survivability of a gun system, there is a need to provide a shroud for a gun barrel providing a combination of radar and IR signature reduction. The shroud must be capable of reducing the heat signature created due to repeated firing of the gun. The exterior of the shroud must be dimensioned and fabricated so as to eliminate or at least reduce radar backscatter. Further, the shroud must conceal the entire length of the barrel both before and during displacement created by the recoil. Finally, the shroud must have minimal weight and inertia so as not to adversely impact the primary function of pointing the gun barrel at the target.

SUMMARY OF THE INVENTION

The present invention is a multi-piece barrel shroud. The invention provides IR signature and radar backscatter reduction for the entire length of the barrel. The external dimensions of the shroud pieces are shaped so that radar waves strike at close to tangential angles to minimize backscatter. In addition, the shroud is covered by special coatings and/or absorbers for radar energy absorption or cancellation. The interior of the shroud can be a honeycomb or multi layer design so that air passages are created for the forced circulation of ambient air to reduce the IR signature. The multi-piece shroud may also contain insulating layers to further eliminate the thermal signature. The forced air circulation system further directs ambient air across the muzzle plane to reduce the barrel axis IR signature.

To facilitate barrel movement while minimizing weight, the shroud is constructed of multiple pieces The majority of the shroud is of a light weight construction because it slidably engages the aft end of the barrel. A first end is fixedly attached to the gun mount. The opposing end, closer to the muzzle, slidably engages the barrel. At least one other piece of the shroud is fixedly attached to the barrel near the muzzle. The muzzle portion contains a rigid support structure to withstand the rapid acceleration/decelerations and muzzle blast created by firing the gun.

BRIEF DESCRIPTION OF THE DRAWINGS

FIG. 3 is an enlarged, fragmenting perspective view of the shroud system in place on a gun barrel.

DETAILED DESCRIPTION OF THE DRAWINGS

Figure 1:
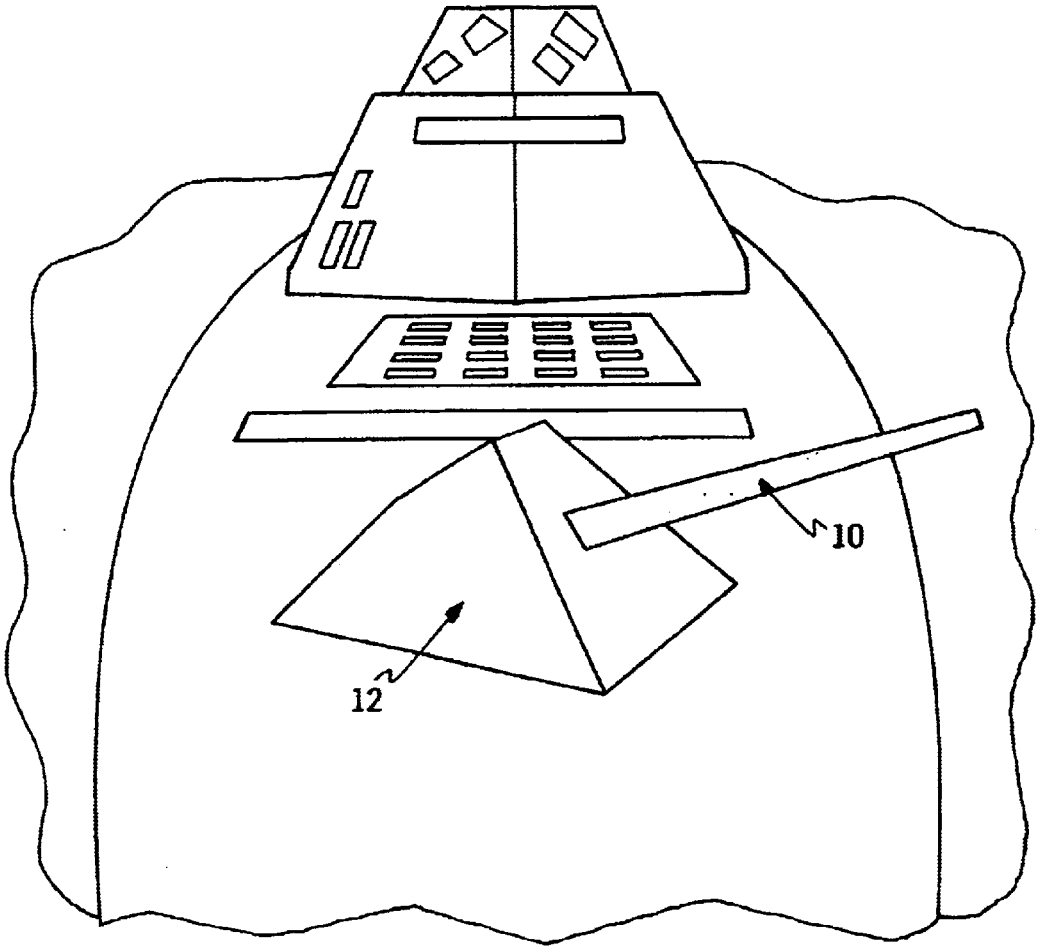
FIG. 1 is a pictorial view of a ship having a gun mount incorporating a gun barrel shroud system in accordance with the present invention.
Figure 2:
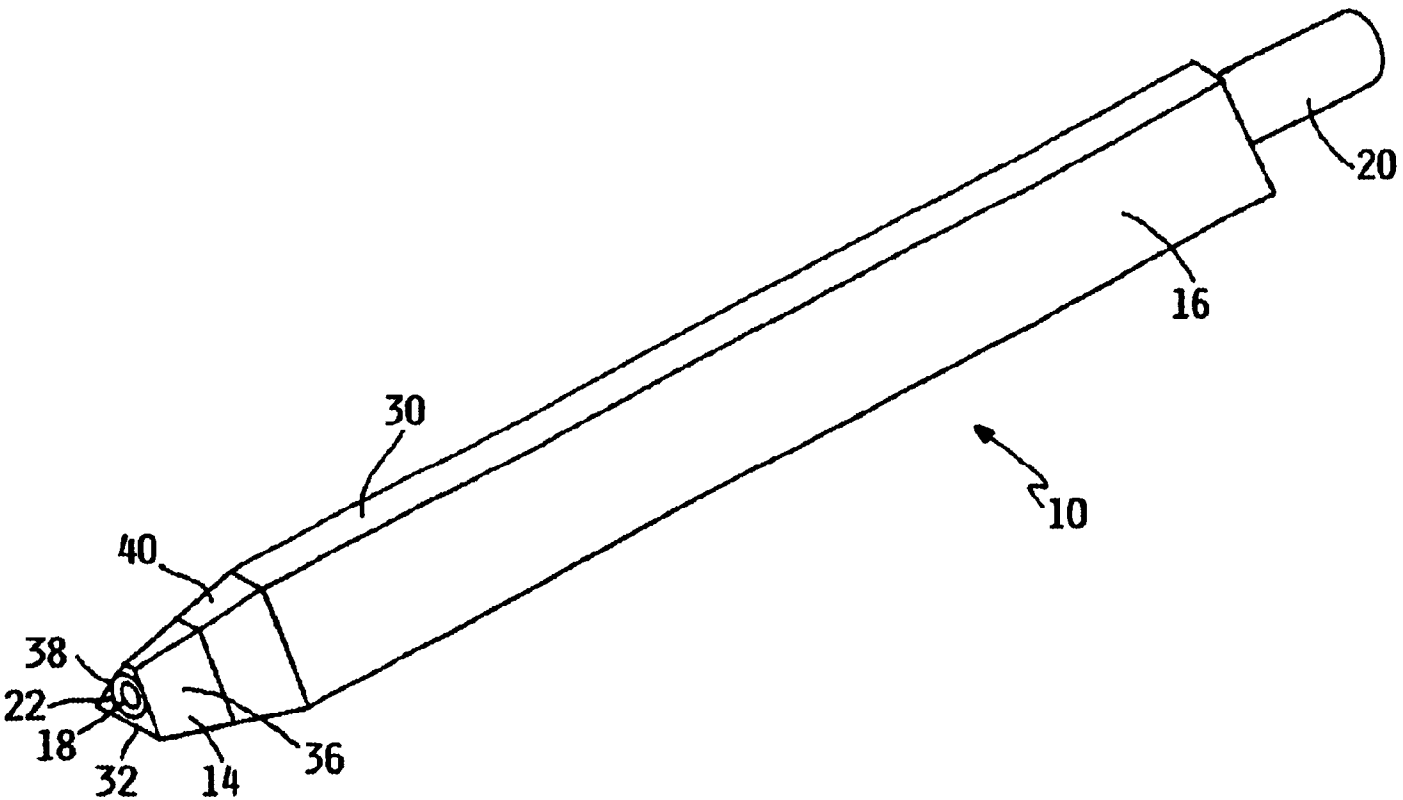
FIG. 2 is a perspective view of the gun barrel shroud system in place on a gun barrel.

The present invention consists of a multi-piece shroud assembly 10 that is an element of a stealth ship design as illustrated in FIG. 1. Stealth technology is a complex design philosophy for reducing the ability of an opponent's sensors to detect, track and attack an aircraft or warship. Signature reduction for a warship requires an integrated topside design with an advanced superstructure shape and advanced multi-function apertures. Integration of the gun into the overall topside stealth design is difficult due to its functional shape requirements. Therefore, the present invention provides means to reduce the guns infrared (IR) and radar signature through the addition of a shroud structure 10.

Unlike other structural topside elements, the barrel 20 of the gun must be capable of withstanding dramatic movements. Recoil of the gun barrel 20 results in large dynamic forces with accelerations in excess of one hundred times that of gravity ("100 G's"). The recoil system decelerates the gun barrel 20 and the recuperator system rapidly returns it to the pre-fire position. This firing procedure may be repeated twelve times in one minute. To accomplish its design objections, the shroud 10 maintains position throughout the recoil cycle.

In addition to designing for recoil, the present invention is compatible with operational limitations. Firing the gun creates a conical shock wave off the nose of the projectile at supersonic speeds and releases a barrel pressure blowdown after the shot leaves the muzzle 22. These effects are jointly referred to as the muzzle blast. The muzzle blast necessarily impinges any structure forward of the muzzle plane 18. The shroud structure required to survive the muzzle blast must be substantially rigid, however, the structure cannot adversely impact or stress the gun drive motors required for rotation and elevation of the barrel 20. Therefore, to control weight and maximize performance, the shroud 10 is divided into two major portions based on structural requirements; the muzzle shroud 14 and the stationary shroud 16.

Figure 6:
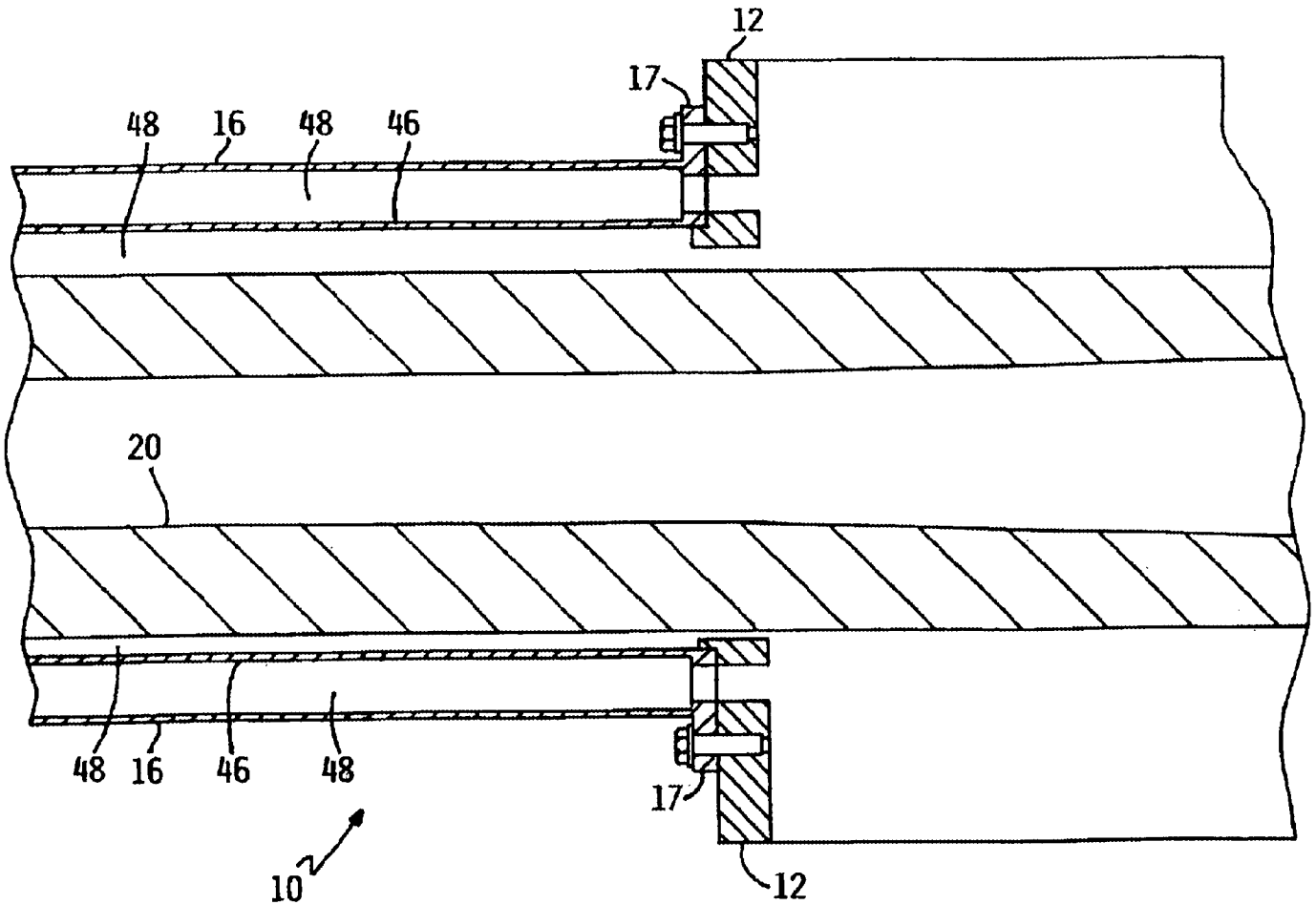
FIG. 6 is a sectional fragmentary view of the gun mount section of the shroud system on a gun barrel.

The stationary shroud 16 extends the majority of the length of the gun barrel 20, extending from the gun mount 12 outboard to proximate the muzzle 22. By avoiding the recoil force, the support structure requirements are driven simply by weight and surface rigidity of stationary shroud 16. In a first embodiment, the stationary shroud 16 is attached to the non-recoiling portion of the gun mount 12 at the proximal end while the distal end is either free floating or slidably disposed by way of an annular support collar. As illustrated in FIG. 6, stationary shroud 16 contains a slotted flange 17 which is bolted on to the elevating structure of gun mount 12. The stationary shroud 16 itself may be further divided into multiple sections that are also independent of recoil of barrel 20. Alternate embodiments could include proximal and distal support collars which allow independent barrel movement for each section of stationary shroud 16.

The muzzle shroud 14 of the present invention is rigidly attached to the barrel 20 proximate the muzzle 22. The muzzle shroud 14 has a tapered profile which expands from the muzzle 22 aft. A plurality of muzzle mounts 26, circumferentially spaced about the barrel 20 provide means to attach the muzzle shroud 14 to the barrel 20 through the respective mounting arms 28. The muzzle mounts 26 are four sets of partial threads circumferentially spaced, machined so as to extend above the external surface of the barrel 20. The muzzle mount arms 28 are inserted bayonet fashion onto the barrel 20 and rotated a quarter turn so as to engage the muzzle mounts 26. Preferably a key is used to maintain position.

As part of the recoiling mass, the muzzle shroud 14 will experience all the forces associated with the recoil and thus requires a substantially heavier frame than that of the stationary shroud 16. In order to reduce overall weight, the length of the muzzle shroud 14 is preferably minimized in relation to the overall length of shroud 10.

Figure 4:
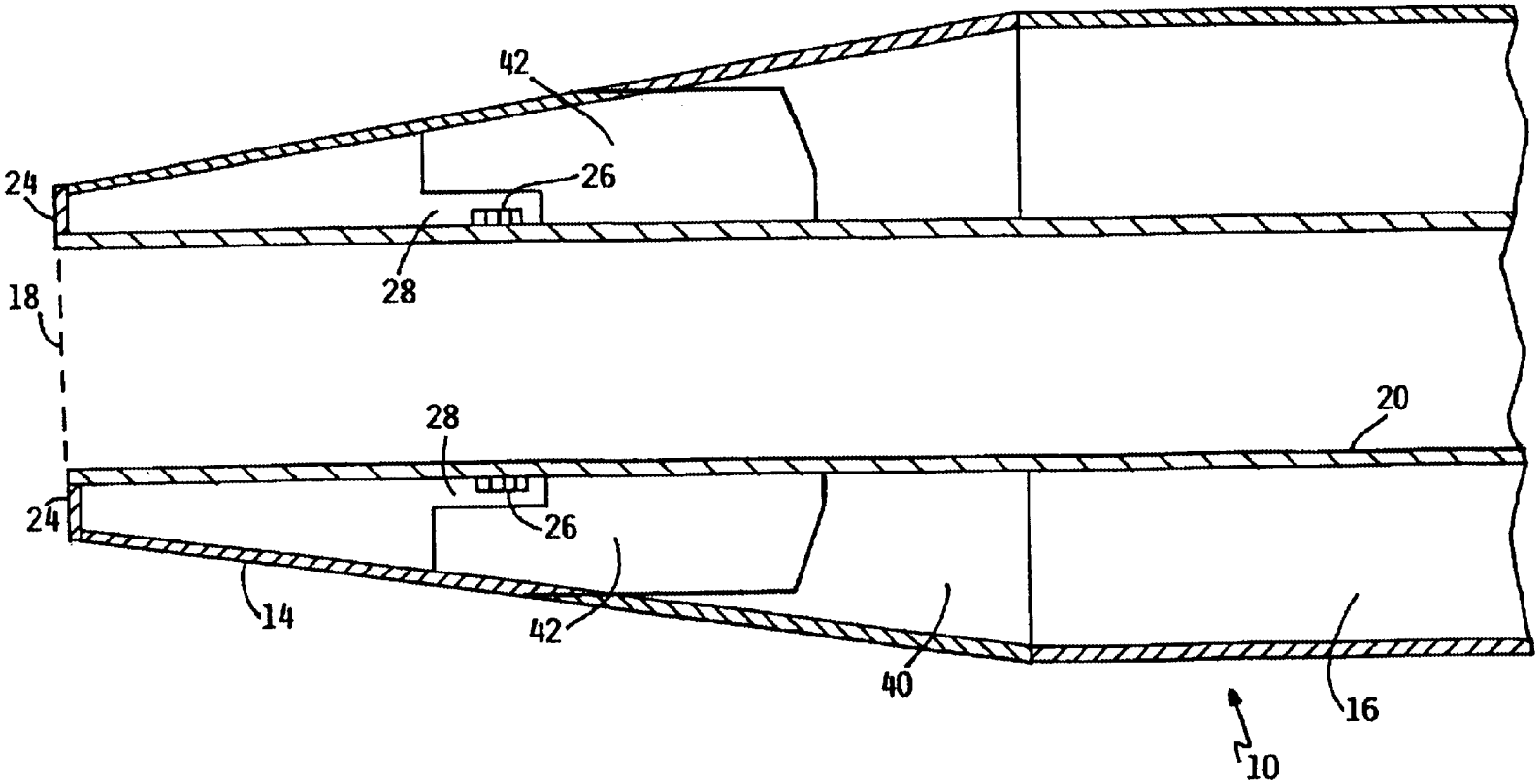
FIG. 4 is a sectional fragmentary view of the muzzle section of the shroud system on a gun barrel before recoil.
Figure 5:
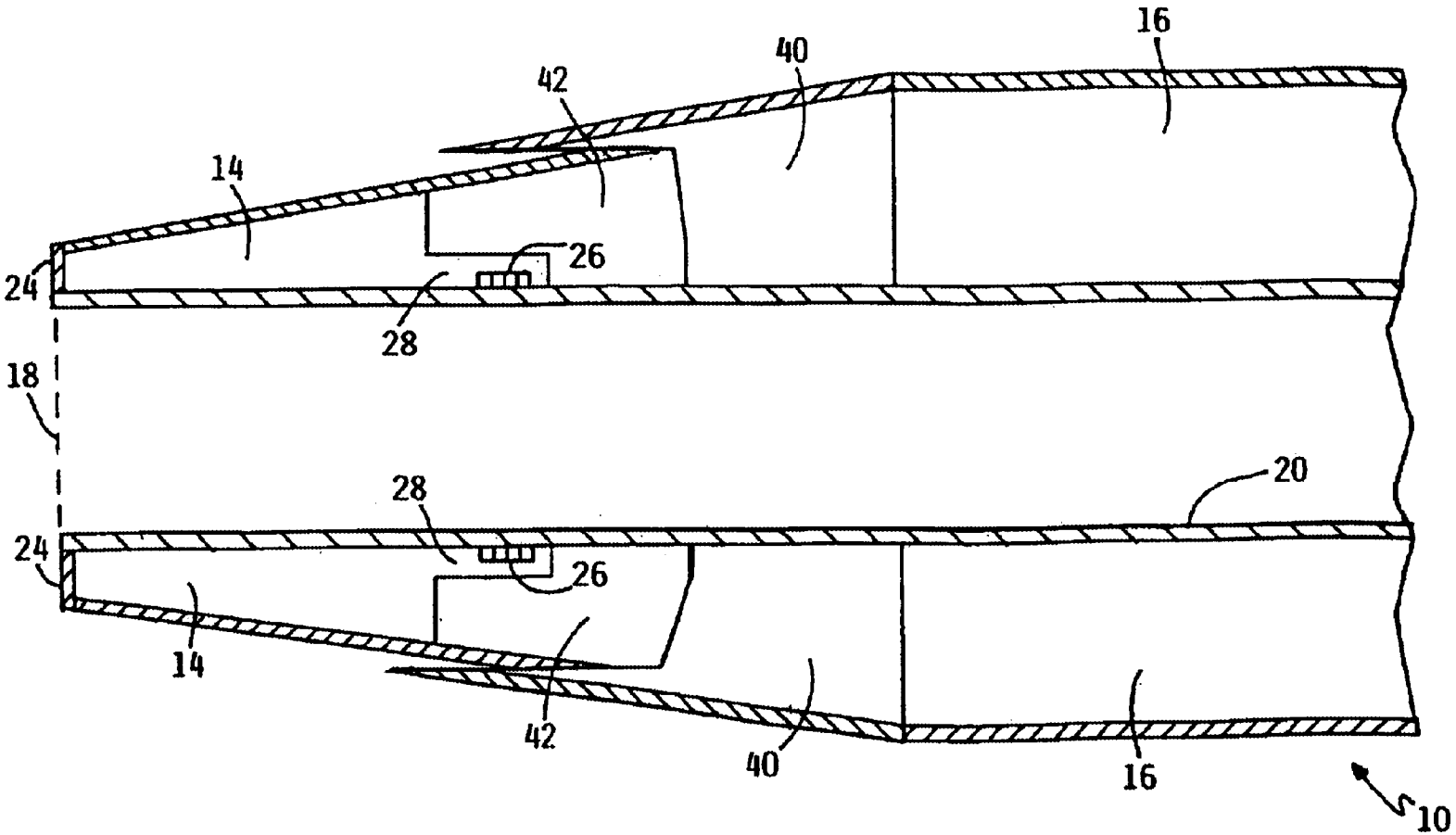
FIG. 5 is similar to FIG. 4, but depicted with the gun barrel during recoil.

FIGS. 4 and 5 depict the preferred interaction between the stationary shroud 16 and muzzle shroud 14 which experiences recoil. During recoil of gun barrel 20, muzzle shroud 14 will rapidly move toward gun mount 12. In order to provide complete coverage of the barrel 20 during recoil, the muzzle shroud 14 must be configured so as to travel either over the exterior or into the interior of the interface section 40.

In a preferred embodiment as depicted in FIG. 4, the interface section 40 is a continuation of stationary shroud 16. Like stationary shroud section 16, interface section 40 is positionally independent of barrel 20, thus avoiding the recoil forces. In alternate embodiments, interface section 40 may either be a separate section or a continuation of stationary shroud section 16. If the interface section 40 is independent, the adjacent faces of interface section 40 are flush with muzzle shroud 14 and stationary shroud 16 so as to provide complete coverage of the exposed barrel 20.

As depicted in FIGS. 4 and 5, the muzzle shroud 14 is configured to travel into annular recess 42 within interface section 40 without imparting any force onto the stationary shroud 16. The outer dimensions of muzzle shroud 14 are less than the dimensions of the opening of annular recess 42. The depth of annular recess 42 is sized to accommodate maximum recoil travel of muzzle shroud 14.

In an alternate embodiment, muzzle shroud 14 may be sized to travel over interface section 40. Muzzle shroud 14 may include expandable sidewall joints or hinged walls which facilitate travel over interface section 40. The length of muzzle shroud 14 could also be extended aft beyond the tapered nose area with an internal annular recess for accepting the distal end of stationary shroud 16 during recoil. Expanding the size of muzzle shroud 14 would result in an increase in overall structural weight of the shroud 10.

Stealth design includes limiting an opponent's ability to detect temperature differences as well as radar signatures. The heat generated by firing a gun provides a clear IR signature if not cloaked in some manner. Infrared signature reduction of shroud 10 is provided by a forced air circulation system. Forced airflow through shroud 10 prevents a temperature increase of the outer surface of shroud 10 due to heat soak from the gun barrel. Note that the air circulation is not the cooling mechanism for the barrel 10. A separate cooling system is used for barrel and recoil thermal dissipation. However, even the most effective thermal dissipation system may result in a barrel more than a hundred degrees above the ambient air. Preferably, ambient airflow can be provided to the shroud 10 by blowers mounted in the gun mount 12. Airflow may also be generated through the shroud 10 if the gun mount 12 is overpressurized.

In an alternate embodiment, infrared signature reduction can be further enhanced by adding insulation to the shroud 10. The exterior wall of shroud 10 can be either single wall or multi-wall construction with layers of insulation interspersed depending on the thermal signature. Furthermore, one or more internal walls 46 could be inserted, creating multiple cooling chambers 48, through which ambient air would be circulated as illustrated by FIG. 6. By using a combination of insulating elements, forced air circulation channels and structural design, thermal bleed from the barrel 20 can be contained within the shroud 10.

There are two primary ways to achieve passive radar cross section reduction; shaping to minimize backscatter and surface coatings for energy absorption or cancellation. The shroud 10, like the entire superstructure of a stealthy ship design, is shaped to reduce radar backscatter. The geometry of the outer surface of the shroud assembly 10 avoids the use of dihedral angles and surfaces normal to the proposed threat axis.

The exterior surface geometry of the shroud 10 is comprised of multiple flat facets providing tangential reflection of radar. In a first embodiment, the present invention 10 has four sides with a generally trapezoidal cross section. The top face 30 extends parallel to the longer bottom face 32. Side faces 36 and 38 are substantially equal in length and connect top face 30 with bottom face 32. To minimize backscatter from radar directed at the barrel axis, the side faces of the shroud 10 generally converge at the muzzle plane 18. The cross section of the shroud 10 is greatest adjacent to gun mount 12. The taper of the shroud 10 increases proximate the interface section 40, disposed between muzzle shroud 14 and stationary shroud 16. The forward face 24 of the muzzle shroud 14 is disposed proximate the muzzle 22 but does not extend in advance of muzzle 22 due to the muzzle blast effect.

The surface of shroud 10 incorporates special surface materials in accordance with commonly known radar signature reduction techniques. The present invention will employ coatings whose electric and magnetic properties allow absorption of microwave energy at discrete or broadband frequencies. Due to environmental conditions expected aboard a ship, the preferred embodiment utilizes at least one layer of elastomeric type absorber although multiple layers may be added, including layers of foam absorbers, to counteract multiple radar frequencies.

Other embodiments of the device and method in addition to the ones described herein are indicated to be within the scope and breadth of the present application. Accordingly, the applicant intends to be limited only by the claims appended hereto.

What is claimed is:

1. A gun barrel shrouding system for reducing the infrared and radar signature of said gun barrel, the system comprising:

a first rigid shroud section, substantially encompassing the majority of the length of said gun barrel, and slidably disposed so as to be independent of gun barrel recoil; and a second rigid shroud section, substantially encompassing the muzzle piece of said gun barrel, said second section fixedly attached at a first end to the muzzle of the gun barrel and with a second end extending distally so as to provide for coverage substantially along the full length of said gun barrel, wherein said first rigid shroud section includes an interface section for accepting the second end of the second rigid shroud section during recoil of the gun barrel.

2. The gun barrel shrouding system of claim 1 wherein radar absorbing materials cover the first and second rigid shroud sections.

3. The gun barrel shrouding system of claim 2 wherein exterior surface of the first and second rigid shroud section is covered by an elastomeric absorber.

4. The gun barrel shrouding system of claim 2 wherein the exterior surface of the first and second shroud is covered by a foam broadband absorber.

5. The gun barrel shrouding system of claim 1 wherein the external shape of the first and second rigid shroud sections are faceted to reduce radar backscatter.

6. The gun barrel shrouding system of claim 5 wherein the exterior of the first and second rigid shroud sections is shaped to substantially reduce radar backscatter by incorporating tangential surfaces and non-dihedral angles.

7. The gun barrel shrouding system of claim 1 wherein the first rigid shroud section includes a plurality of circumferentially spaced cooling channels, axially extending from a gun mount to an outboard end, through which a forced air circulation system blows a stream of ambient air.

8. The gun barrel shrouding system of claim 7 wherein the forced air circulation system is located within the first rigid shroud section.

9. The gun barrel shrouding system of claim 7 wherein the forced air circulation system is located within the gun mount.

10. The gun barrel shrouding system of claim 1 wherein the first rigid shroud section includes at least one wall radially encompassing the barrel.

11. The gun barrel shrouding system of claim 10 wherein the first rigid shroud section includes at least an additional internal wall radially encompassing the barrel.

12. The gun barrel shrouding system of claim 11 wherein the additional internal wall defines additional circumferentially spaced cooling channels.

13. The gun barrel shrouding system of claim 11 wherein the additional internal walls are constructed of insulating materials.

14. The gun barrel shrouding system of claim 1 wherein the second rigid shroud section tapers down from the interface section of the first rigid shroud section to partially shroud the muzzle.

15. The gun barrel shrouding system of claim 1 wherein the interface section of the first rigid shroud section defines an annular recess sized to accommodate a portion of the second shroud section during recoil of the barrel.

16. The gun barrel shrouding system of claim 15 wherein the exterior dimensions of the second end of the second rigid shroud section is less than the outer radial dimension of the annular recess of the first rigid shroud section.

17. The gun barrel shrouding system of claim 1 wherein the second rigid shroud section contains a plurality of circumferentially spaced axially extending cooling channels, said channels being contiguous with the channels of the first rigid shroud section.

18. The gun barrel shrouding system of claim 17 wherein the cooling channels direct airflow across the muzzle plane of the gun barrel.

19. The gun barrel shrouding system of claim 1 wherein the first rigid shroud section overlaps a portion of the second rigid shroud section.

20. The gun barrel shrouding system of claim 1 wherein the second end of the second rigid shroud section abuts a free end of the first rigid shroud section.

21. The gun barrel shrouding system of claim 1 wherein the interface section of the first rigid shroud section tapers so that the second end of the second rigid shroud section slides over the interface section of the first rigid shroud section during recoil of the barrel.

22. A method of reducing the infrared and radar signature of a gun barrel, said method comprising:

shrouding the barrel within a multi-piece shroud from a gun mount to a gun muzzle; wherein said multi-piece shroud includes a gun muzzle element fixed at a proximal end to the gun muzzle so as to move with the gun barrel during recoil, and a gun mount element fixed to the gun mount at a first end and slidably engaging the gun barrel at a second end, said gun muzzle element has a distal end which overlaps the second end of the gun mount element during recoil; and cooling the multi-piece shroud through a forced air circulation system;

shaping the exterior of the shroud to reduce radar backscatter;

covering the shroud with radar absorbing materials;

installing at least one layer of insulation to reduce an infrared signature; and cooling the muzzle by directing air across the muzzle plane.

23. The method of claim 20 wherein the gun mount element of the shroud is stationary so as to maintain position independent of the gun barrel during recoil.

24. The method of claim 20 wherein the multi-piece shroud contains at least one internal insulating layer.

25. The method of claim 20 wherein shaping the exterior of the shroud includes a plurality of tangentially disposed outer surfaces.

26. The method of claim 20 further including installing at least one internal shroud wall to reduce the infrared signature.

27. A gun barrel having a substantially cylindrical shape which extends from a gun mount to a muzzle, said barrel being surrounded by a multi-piece rigid shroud having the same longitudinal axis as said barrel, wherein said multi-piece rigid shroud comprises a stationary shroud portion and a muzzle shroud portion, said stationary shroud portion having a proximal end disposed adjacent to the gun mount and a distal end outboard of the gun mount, and said muzzle shroud portion having a proximal end disposed relative to the muzzle and a distal end which engages the distal end of the stationary shroud portion during recoil, said stationary shroud portion including an interface section with an annular recess for accepting the distal end of the muzzle shroud portion during recoil of the gun barrel; said multi-piece rigid shroud including;

infrared signature reducing means, said means comprising a forced air circulation system which circulates ambient air through a plurality of internal channels within the shroud; and radar backscatter reducing means, said means comprising selectively installing material to the exterior of the shroud which absorbs or cancels radar backscatter and shaping the shroud out of a plurality of tangentially disposed surfaces which minimize radar returns.

28. The gun barrel of claim 27 wherein the exterior of the muzzle shroud portion tapers outward as it extends aft from the muzzle toward the interface section of the stationary shroud portion.

29. The gun barrel claim 28 wherein the exterior dimensions of the distal end of the muzzle shroud is less than the outer radial dimension of the annular recess of the stationary shroud portion.

30. The gun barrel of claim 27 wherein the infrared signature reducing means further includes adding at least one insulating layer to the shroud.

31. The gun barrel of claim 30 wherein the infrared signature reducing means further includes adding multiple layers of air channels to the interior of the shroud.

32. The gun barrel of claim 27 wherein the infrared signature reducing means further includes channeling ambient air over a muzzle plane of the gun barrel.

33. The gun barrel of claim 27 wherein radar backscatter reducing means includes covering the stationary shroud portion and muzzle shroud portion with at least one layer of an elastomeric absorber.

34. The gun barrel shrouding system of claim 27 wherein radar backscatter reducing means includes covering the stationary shroud portion and muzzle shroud portion with at least one layer of a foam broadband absorber.

35. The gun barrel shrouding system of claim 27 wherein radar backscatter reducing means includes covering the stationary shroud portion and muzzle shroud portion with at least one layer of a foam broadband absorber and at least one layer of a elastomeric absorber.

* * * * *